US005795219A

United States Patent [19]

Bloom

[11] Patent Number: 5,795,219

[45] Date of Patent: Aug. 18, 1998

[54] NAIL POLISHING WORKSTATION WITH VENTILATION AND CAROUSEL TRAY

[75] Inventor: Ira Gary Bloom, University Park, Tex.

[73] Assignee: ASR Affiliates, Inc., Dallas, Tex.

[21] Appl. No.: 829,324

[22] Filed: Mar. 27, 1997

[51] Int. Cl.[6] ..... B08B 15/04

[52] U.S. Cl. ..... 454/49; 211/131.1; 454/341; 454/345

[58] Field of Search ..... 454/49, 67, 252, 454/306, 341, 345; 132/75; 211/131.1

[56] References Cited

U.S. PATENT DOCUMENTS

| | | | |
|---|---|---|---|
| 2,341,628 | 2/1944 | Koweindl . | |
| 2,347,334 | 4/1944 | Schmieg . | |
| 3,266,634 | 8/1966 | Tintary | 211/131.1 |
| 3,301,167 | 1/1967 | Howard et al. . | |
| 3,503,523 | 3/1970 | Hamilton et al. | 211/131.1 |
| 3,559,383 | 2/1971 | McCabe . | |
| 3,587,592 | 6/1971 | Price . | |
| 3,926,597 | 12/1975 | Landy . | |
| 4,248,162 | 2/1981 | Skeist . | |
| 4,280,519 | 7/1981 | Chapman . | |
| 4,297,940 | 11/1981 | Hainline . | |
| 4,490,881 | 1/1985 | Schmidt . | |
| 4,512,245 | 4/1985 | Goldman . | |
| 4,625,633 | 12/1986 | Martin | 454/49 |
| 4,642,852 | 2/1987 | Turner et al. . | |
| 4,647,295 | 3/1987 | Christ . | |
| 4,852,468 | 8/1989 | Harris . | |
| 4,898,089 | 2/1990 | Roos . | |
| 5,112,373 | 5/1992 | Pham . | |
| 5,131,192 | 7/1992 | Cheng . | |
| 5,139,546 | 8/1992 | Novobilski . | |
| 5,244,433 | 9/1993 | Utterback . | |
| 5,277,488 | 1/1994 | Cleary et al. | 211/131.1 X |
| 5,303,659 | 4/1994 | Berlin et al. . | |
| 5,322,473 | 6/1994 | Hofstra et al. | 454/306 X |
| 5,464,029 | 11/1995 | Rentz . | |
| 5,499,945 | 3/1996 | Ferlin et al. . | |
| 5,514,037 | 5/1996 | Downey, Jr. . | |
| 5,526,620 | 6/1996 | Hallsten . | |
| 5,562,286 | 10/1996 | Brinket | 454/306 X |
| 5,621,929 | 4/1997 | Smith | 454/49 X |

*Primary Examiner*—Harold Joyce
*Attorney, Agent, or Firm*—Gregory M. Howison; Mark W. Handley

[57] ABSTRACT

A nail sculpting station (12) is provided having a plurality of workstations (14), each of the workstations (14) having a work surface 16, a customer arm rest (18) and an exhaust vent (20). A customer's nails are manicured and sculpted while disposed above one of the exhaust vents (20) such that fumes and dust created during the manicuring and sculpting of the customer's nails will be drawn into the exhaust vents (20). The exhaust vents (20) of each of the workstations (14) are connected to a central exhaust duct 26which passes through a central region (24) of the nail sculpting station (12) and through the ceiling (38) above the nail sculpting station (12). The fumes and dust are exhausted exteriorly of the air space within which the nail sculpting technician and the customer are located. The air flow is preferably at a level which will cause as sufficient amount of air to be drawn over the customer's nails when disposed on the ventilation openings of the exhaust vent (20), such that dust and fumes will be drawn through the exhaust vents (20) without disturbing the thickness or consistency of the coating of the nails, and removing the obnoxious fumes. Rotatory carousels (28, 30) is provided for sharing supplies between adjacent workstations (14).

8 Claims, 2 Drawing Sheets

NAIL POLISHING WORKSTATION WITH VENTILATION AND CAROUSEL TRAY

TECHNICAL FIELD OF THE INVENTION

The present invention pertains in general to an apparatus for staging supplies and removing fumes and dust and, more particularly, to an apparatus which provides a work station for laying out nail sculpting supplies and removing fumes and dust which occur during adornment of nails and human hand.

BACKGROUND OF THE INVENTION

The treatment of human nails for aesthetic purposes generally involves the application of a liquid acrylic which sets to produce a nail-like member or a wrap which may be a suitable material, such as silk, fiberglass, linen, or the like, hooded with an acrylic or other material designed to set and produce a nail-like member. In some instances, these nails are produced for later application to the fingers of a customer, but many beauty salons and shops specializing in nail care construct the sculptured nails directly on the fingers of a customer. Regardless of the technique involved, however, the roughly formed nails must be filed or ground down to the shape desired and one or more coats of nail polish must be applied to complete the nail in a form which is aesthetically pleasing to the customer.

The manufacture of such nails requires the use of a number of toxic materials, including solvents, hardeners, and the like. These can include acetone, propanol, ethyl methacrylate, as well as dust particles emitted by filing the wrap made out of materials such as silk, fiberglass, or linen. The acrylic and other liquids employed give off distasteful or obnoxious fumes and the trimming of the nails accompanied by cutters or files emits dust particles which are similarly objectionable and in fact, could be harmful to the customer and especially to the technician who is exposed to such fumes over extended periods.

Nail technicians typically work at a small table with a customer seated across the table from the nail technician. The customer's fingernails are prepared with solvents and a sculptured nails are built up using acrylics. Multiple applications are usually made, each followed by a drying period during which volatile components evaporate into the atmosphere, and then followed by the step of sanding to shape the nail. Finally, a clear or colored layer of polish is applied. During this drying period, the potential for dust particles to embed in the final layers is high. In the past, it was common practice to permit the obnoxious fumes and particulate laden air to disperse without any positive effort to remove them, while the dust collecting in the work area was occasionally swept away with a brush or a dust pan. Some positive efforts have been made to remove these materials on an ongoing basis, such as using exhaust fans and/or hoods to vent the toxic fumes away from the work area. However, adding exhaust ducting and exhaust vents reduces the effective size of the work area which a technician may use for laying- out supplies used in sculpting nails. Often, common supplies are shared by technicians at adjacent workstations.

SUMMARY OF THE INVENTION

The present invention disclosed and claimed herein comprises a nail sculpting station which includes a plurality of workstations used for the treatment of nails on the human hand in the form of filing the nails and applying a nail polish coating to a desired thickness that gives off fumes while drying. The nail sculpting station includes work surfaces, a plurality of exhaust ventilation openings, or exhaust vents, in the work surfaces, exhaust ducting and an exhaust fan. A customer's hand is places atop one of the exhaust vents. The exhaust vents are connected to exhaust ducts, and the exhaust ducts are connected to a central exhaust duct which is connected to an exhaust fan. The central exhaust duct extends upward through the ceiling. The exhaust fan produces a low pressure area above the work table and therefore creates an air flow to draw fumes and dust into the exhaust vents, through the exhaust ducts and into the fan, which expels them into ambient air exterior of the space within which a technician and a customer are located. The air flow is at a level that will cause a sufficient amount of air to be drawn over the nails when disposed on the exhaust vents, such that dust and fumes will be drawn downward into the exhaust vents without disturbing the thickness and the consistency of the nail polish coating. A supply carousel is provided by trays which are rotatably mounted to the central exhaust duct for sharing supplies between adjacent workstations.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
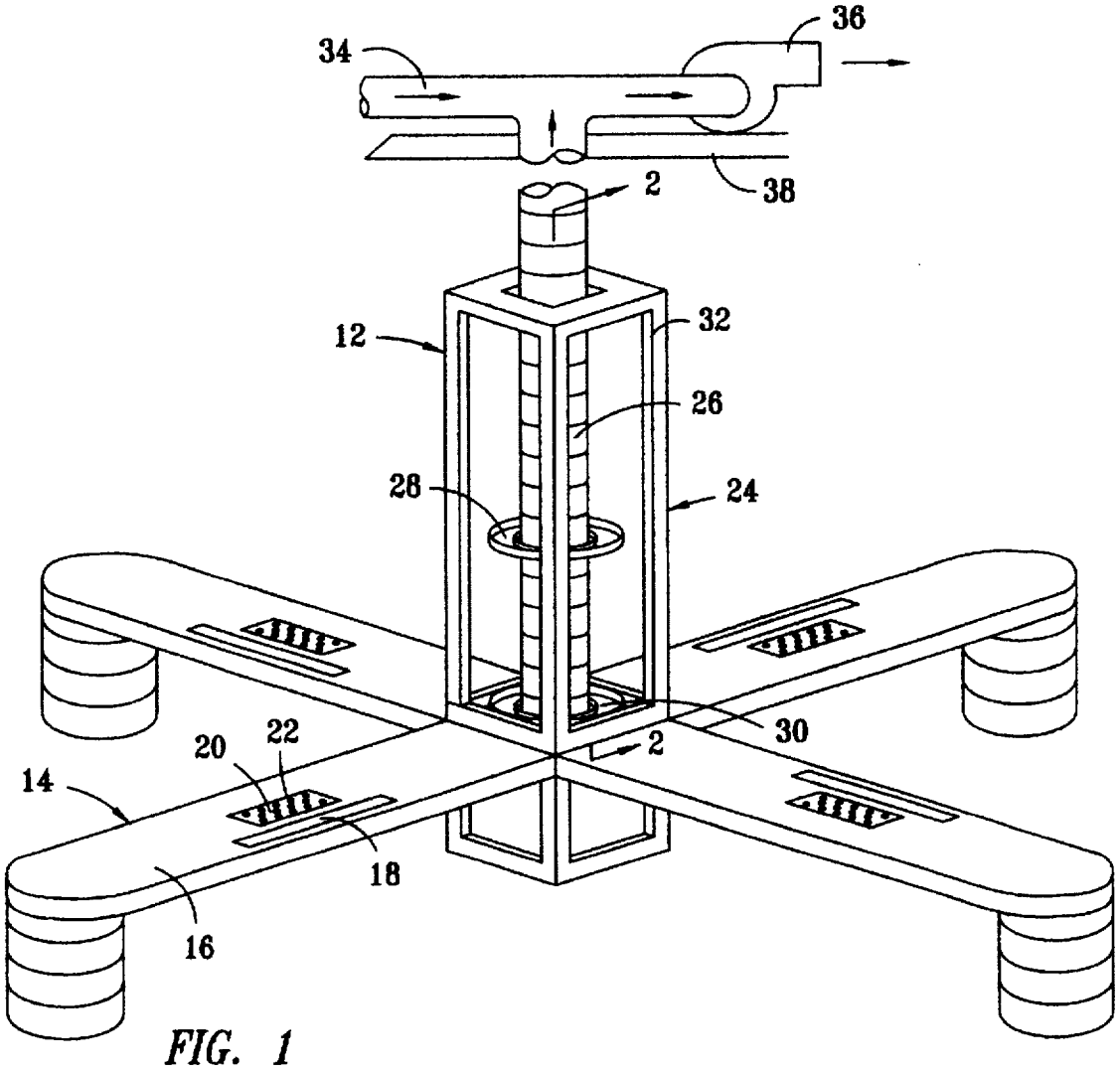
FIG. 1 illustrates a perspective view of a nail sculpting station made according to the present invention.

Referring now to FIG. 1, there is illustrated a perspective view of a nail sculpting station 12 made according to the present invention. The nail sculpting station 12 preferably includes four (4) workstations 14. Each of the workstations 14 has a work surface 16. A padded customer arm rest 18 is mounted to the top of each of the work surfaces 16. Exhaust vents 20 are also mounted to the work surfaces 16, spaced apart from the customer arm rest 18 approximately four (4) to six (6) inches.

The exhaust vents 20 have perforations 22 for passing ambient air in response to a vacuum being drawn beneath the vents 20. The perforations 22 define ventilation openings. The exhaust vents 20 are slightly larger than a human hand.

The nail sculpting station 12 includes a central region 24. A central exhaust duct 26 extends vertically upwards through the central region 24 for passing air collected at the four (4) exhaust vents 20. The exhaust ducting 26 is preferably formed of a six (6) inch PVC pipe, but in other embodiments, it may be provided by standard sheet metal ducting and the like. The longitudinal axis of the central exhaust duct 26 is vertical. An upper tray 28 and a lower tray 30 are mounted around the exterior of the exhaust duct 26. The upper tray 28 and the lower tray 30 are formed of plywood. Preferably, the upper tray 28 and the lower tray 30 are rotatably mounted to the central exhaust duct 26, such that they each provide a rotary carousel, or lazy susan, for staging supplies which are shared between the workstations 14. A decorative framework 32 extends upward around the exhaust duct 26, outwardly disposed from the upper tray 28 and the lower tray 30. Storage cabinets may be located in the lowermost portion of the central region 24, between the work surfaces 16 and the floor.

The central exhaust duct 26 extends upward and T's into a branch duct 34, which preferably extends to at least one other nail sculpting station not shown. The exhaust duct 26 and the branch duct 34 connect to a central header, which connects directly to an exhaust fan 36. The exhaust fan 36 is mounted above the ceiling 38, and preferably is roof mounted. The exhaust fan 36 discharges fumes and dust collected at the nail sculpting station 12 exteriorly of the building within the which the nail sculpting station 12 is located.

Figure 2:
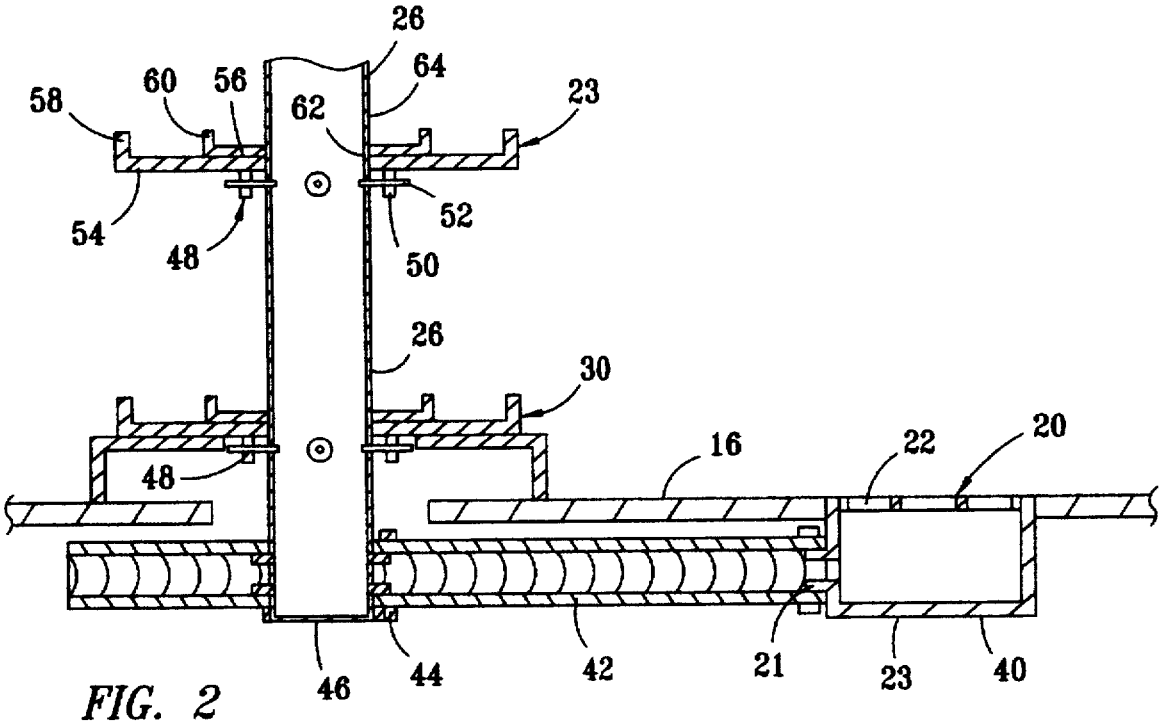
FIG. 2 illustrates a partial section view of the nail sculpting station of FIG. 1, taken along section line 2—2.

Referring now to FIG. 2, there is illustrated a partial section view of the nail sculpting station 12, taken along section line 2—2 of FIG. 1. An exhaust plenum 40 is disposed beneath each of the exhaust vents 20, with the exhaust vents 20 provided by perforated plates which mount flush with the tops of the work surfaces 16. The exhaust plenums 40 are preferably provided by rectangular sheet metal enclosures which are sealed to prevent exhaust leaks, except for the upper surface to which the exhaust vents 20 mount and a round duct connection 21 for connecting exhaust ducting 42 to the plenums 40. The lowermost end of the duct connection 21 is disposed approximately one (1) inch above the bottom 23 of the plenum 40, such that nail clippings will fall to the bottom 23 of the plenum 40 rather than being entrained within the exhaust air flowing into exhaust ducting 42. The exhaust vents 20 are provided by a steel grating which may be lifted upwards so that clippings may be periodically cleaned from within the plenums 40. Preferably, the exhaust ducting 42 is formed of a flexible ducting and extends to duct connections 44 of the exhaust duct 26. Four (4) of the duct connections 44 are provided, one for each of the workstations 14. An end cap 46 is mounted to the lower most end of the exhaust duct 26.

The upper tray 28 and the lower tray 30 are rotatably mounted to the exhaust duct 26 by roller assemblies 48. Preferably, four (4) of the roller assemblies 48 are provided for rotatably mounting the upper tray 28, and four (4) of the roller assemblies 48 are provided for mounting the lower tray 30. Each of the roller assemblies includes a nylon roller 50, and a mounting shaft 52 to which the roller 50 is rotatably mounted. The mounting shafts are preferably threaded such that they screw into the central air duct 26. The upper tray 28 and the lower tray 30 each rest upon a set of four (4) of the roller assemblies 48.

The upper tray 28 and the lower tray 30 each include an outer tray 54 and an inner tray 56, which have a lip 58 and a lip 60, respectively. The inner tray 56 is preferably rigidly secured to the outer tray 54 by an adhesive. In other embodiments, the inner trays 56 and the outer tray 54 may be formed as a singular unit. In yet other embodiments, the inner tray 56 may be rotatable relative to the outer tray 54, such that it may be rotated freely with respect to the outer tray 54. For example, the inner diameter 62 of the inner tray 56 may be sized such that it is slightly larger than the outer diameter of the exhaust duct 64, and the lower most surface of the inner tray 56 may slide freely upon the upper surface of the outer tray 54.

The exhaust duct vents 20, the air plenums 40, the exhaust ducting 26 and 42, and the exhaust fan 36 are together sized such that adequate air flow is provided for venting fumes and airborne particulates, such as nail filings. Yet, the continuous air flow therethrough will not be so fast such as to ripple any coatings being applied to the fingernails of customers, or create whistling noises.

In operation, a technician will sit across one of the work surfaces 16 from the customer, with the customer placing her forearm across the arm rest 18 and her hand upon one of the exhaust vents 20. The nail sculpting technician will then manicure and sculpt the customer's nails. Clippings and fumes occurring during manicuring and sculpting operations will be drawn into the exhaust vent 20, through the air plenum 40 and the ducting 42, to the exhaust duct 26. The exhaust duct 26 will then exhaust the clippings and fumes in the atmosphere, preferably to the exterior of the building within which the nail sculpting station 12 is utilized. During manicuring and sculpting operations, commonly used supplies and materials may be shared between each of the adjacent workstations 14 of the nail sculpting station 12. The supplies and materials are placed upon the upper tray 28 and the lower tray 30, which provide rotatable carousels. Utilizing the upper tray 28 and the lower tray 30 within the central region 24 of the nail sculpting station 12 increases the effective size of the work surfaces 16 since commonly used supplies are shared between the various workstations 14 rather than having to be laid out individually on each of the separate work surfaces 16. Obnoxious fumes and particulate matter are exhausted from each of the workstations 14, benefitting both the customer and the nail sculpting technician.

In summary, there is then provided a nail sculpting station having a plurality of work stations, each having a work surface with a padded customer arm rest and exhaust vents. The exhaust vents are connected to a central exhaust air duct. The air exhaust duct extends upward through the ceiling to an exhaust fan. Nail clippings are not entrained within the exhaust passing through the exhaust fan, so that nail clippings will not be dispersed from the exhaust fan and create litter. The discharge of the exhaust fan is preferably to exterior of the building within which the nail sculpting station is located. A central region extends between adjacent ones of the work stations, with carousel trays rotatably mounted to the central exhaust duct for sharing common supplies between the adjacent workstations.

Although the preferred embodiment has been described in detail, it should be understood that various changes, substitutions and alterations can be made therein without departing from the spirit and scope of the invention as defined by the appended claims.

What is claimed is:

1. A nail sculpting station for the treatment of nails on the human hand in the form of filing the nails and applying a nail polish coating, comprising:

a plurality of workstations, each having a work surface;

exhaust vents, one corresponding to each of said workstations for removing fumes and airborne particulate from above respective ones of said work surfaces;

a central exhaust duct;

exhaust ducting connecting said exhaust vents to said central exhaust duct;

an exhaust fan having an inlet connected to said central exhaust duct and having an exhaust connected to a space which is remote from said nail sculpting station for producing a vacuum above said work surfaces and therefore creating a continuous air flow to draw air, fumes and particulate into said exhaust vents, through said exhaust ducting and said central exhaust vent to exhaust the air, fumes and particulate remotely from said work stations; and a supply tray rotatably mounted to an exterior of said central exhaust duct, wherein said exhaust duct provides the support structure for supporting said supply tray.

2. The nail sculpting station of claim 1, wherein said continuous air flow is at a level that will cause a sufficient amount of air to be continuously drawn over the nails when disposed on said ventilation openings, such that the fumes and particulate will be drawn into said exhaust vents without disturbing the thickness and consistency of the nail polish coating.

3. The nail sculpting station of claim 1, wherein said exhaust vents are mounted flush with said work surface.

4. The apparatus of claim 3, wherein said exhaust vents cover an area approximately the size of the human hand.

5. The apparatus of claim 4, wherein said supply tray comprises:

an outer tray, rotatably mounted to said central air duct, said outer tray having a first vertical lip which extends upwards therefrom to define a peripheral edge thereof; and an inner tray, rigidly mounted to said outer tray, said inner tray having a second vertical lip which extends upwards therefrom to define a peripheral edge thereof.

6. The nail sculpting station of claim 1, wherein said exhaust vents are mounted flush with respective ones of said work surfaces, and said exhaust ducting comprises:

exhaust plenums mounted beneath said exhaust vents, said exhaust plenums each having a bottom defining a lowermost surface thereof;

a plurality of outlets, each corresponding to one of said exhaust plenums, and to which a portion of said exhaust ducting is connected for passing the fumes and particulate to said central exhaust duct; and each of said outlets having a lowermost end which is disposed above a respective one of said bottoms of said exhaust plenums, such that nail clippings will fall beneath the paths of the continuous air flow rather than becoming entrained therein.

7. The nail sculpting station of claim 6, wherein said supply tray comprises:

an outer tray, rotatably mounted to said central air duct; and an inner tray, rigidly mounted to said outer tray, said inner tray having a vertical lip which extends upwards therefrom to define a periphery thereof.

8. The nail sculpting station of claim 7, wherein two separate supply trays are rotatably mounted to said central exhaust duct, one spaced apart above the other.

* * * * *